US007025125B2

(12) United States Patent
Sheng et al.

(10) Patent No.: US 7,025,125 B2
(45) Date of Patent: Apr. 11, 2006

(54) HEAT DISSIPATING DEVICE WITH HEAT PIPE

(75) Inventors: Jian-Qing Sheng, Shenzhen (CN); Meng-Tzu Lee, Tu-cheng (TW); Shu-Ho Lin, Tu-cheng (TW)

(73) Assignee: Hon Hai Precision Industry Co., Ltd., Taipei Hsien (TW)

( * ) Notice: Subject to any disclaimer, the term of this patent is extended or adjusted under 35 U.S.C. 154(b) by 79 days.

(21) Appl. No.: 10/892,062

(22) Filed: Jul. 15, 2004

(65) Prior Publication Data

US 2005/0167087 A1 Aug. 4, 2005

(30) Foreign Application Priority Data

Feb. 4, 2004 (CN) ..... 200420044463

(51) Int. Cl.
*F28D 15/00* (2006.01)

(52) U.S. Cl. ..... 165/104.33; 165/104.21; 165/80.4; 361/697; 361/704; 361/700; 257/715; 174/15.2

(58) Field of Classification Search ..... 165/80.3, 165/185, 104.26, 104.21, 104.33; 361/700; 257/714–176; 174/15.2
See application file for complete search history.

(56) References Cited

U.S. PATENT DOCUMENTS

| | | | | |
|---|---|---|---|---|
| 5,651,414 | A * | 7/1997 | Suzuki et al. | 165/104.14 |
| 5,697,428 | A * | 12/1997 | Akachi | 165/104.21 |
| 6,102,110 | A * | 8/2000 | Julien et al. | 165/104.33 |
| 6,167,619 | B1 * | 1/2001 | Beagle | 29/890.043 |
| 6,189,601 | B1 * | 2/2001 | Goodman et al. | 165/80.3 |
| 6,394,175 | B1 * | 5/2002 | Chen et al. | 165/80.3 |
| 6,625,021 | B1 * | 9/2003 | Lofland et al. | 361/697 |
| 2003/0000689 | A1 * | 1/2003 | Kuo et al. | 165/185 |
| 2003/0024687 | A1 * | 2/2003 | Cheng et al. | 165/80.3 |
| 2004/0035558 | A1 | 2/2004 | Todd et al. | 165/104.26 |

FOREIGN PATENT DOCUMENTS

| | | |
|---|---|---|
| CN | 00210761.9 | 12/2000 |
| TW | 496133 | 7/2002 |

* cited by examiner

*Primary Examiner*—Terrell McKinnon

(57) ABSTRACT

A heat dissipating device incorporating heat pipes is disclosed. The heat dissipating device includes a base (10), a plurality of heat-dissipating fins (30) and at least one heat pipe (20). The base defines at least a groove (13) thereon. The heat pipe comprises an evaporating portion (22) received in the groove and a condensing portion (21) extending through the fins. The evaporating portion of the heat pipe is curved so as to increase contact surface between the evaporating portion and the base. The condensing portion of the heat pipe extends perpendicularly away from the base.

16 Claims, 4 Drawing Sheets

HEAT DISSIPATING DEVICE WITH HEAT PIPE

TECHNICAL FIELD

The present invention relates generally to heat dissipating devices for removing heat from heat-generating devices, and more particularly to a heat dissipating device incorporating heat pipes for promoting heat dissipation effect thereof.

BACKGROUND

Computer electronic devices such as central processing units (CPUs) generate lots of heat during normal operation. If not properly removed, such heat can adversely affect the operational stability of computers. Solutions must be taken to efficiently remove the heat from the CPUs. Typically, a heat sink is mounted on a CPU to remove heat therefrom, and a fan is often attached to the heat sink for improving heat-dissipating efficiency of the heat sink. The heat sink commonly comprises a base and a plurality of heat-dissipating fins arranged on the base.

Nowadays, CPUs and other related computer electronic devices are becoming functionally more powerful and more heat is produced consequently, resulting in an increasing need for removing the heat away more rapidly. Conventional heat sinks made of metal materials, even a fan is used, gradually cannot satisfy the need of heat dissipation. Accordingly, another kind of heat dissipating device incorporating heat pipes has been designed to meet the current heat dissipation need, as the heat pipe possesses an extraordinary heat transfer capacity and can quickly transfer heat from one point to another thereof. Commonly, a heat pipe consists of a sealed aluminum or copper container with the internal walls lined with a capillary wick structure that is filled with a working fluid. As the heat pipe absorbs heat at one end thereof, fluid is vaporized, and a pressure gradient is formed in the pipe. This pressure gradient forces the vapor to flow along the pipe from the one end to the other end where the vapor condenses and gives out its latent heat of vaporization. The working fluid is then returned back to the one end of the pipe via the capillary forces developed in the wick structure. When used, an end of the heat pipe is attached to the base of a heat sink, and the other end of the heat pipe is attached to a plurality of heat-dissipating fins of the heat sink. Thus the heat generated by electronic devices is conducted to the base and then rapidly transferred to the heat-dissipating fins via the heat pipe for further dissipating to ambient air.

However, the above-mentioned heat dissipating device incorporating heat pipes has a disadvantage that the heat pipe has a small contact surface with the base of the heat sink. Thus the heat dissipation effect is still not satisfactory.

Therefore, it is desired to design a novel heat dissipating device to overcome the aforementioned problems and increase the heat dissipation effect thereof.

SUMMARY

Accordingly, an object of the present invention is to provide a heat dissipating device incorporating heat pipes which has a large contact surface with the heat sink so as to increase the heat dissipation effect thereof.

In order to achieve the object set out above, a heat dissipating device for removing heat from heat-generating devices in accordance with the present invention comprises a heat receiver, a plurality of heat-dissipating fins and at least one heat pipe. The heat receiver defines at least a groove at a surface thereof. The heat pipe comprises an evaporating portion received in the groove of the heat receiver and a condensing portion extending away from the heat receiver. The fins are attached to the heat pipe and stacked along the condensing portion. The heat pipe absorbs heat from the heat receiver via the evaporating portion and transfers the heat to the fins via the condensing portion. The evaporating portion of the heat pipe is curved in configuration, and the groove of the heat receiver has a mating configuration so as to increase contact surface between the heat pipe and the heat receiver, thereby increasing the heat dissipation effect of the heat dissipating device.

Other objects, advantages and novel features of the present invention will become more apparent from the following detailed description when taken in conjunction with the accompanying drawings, in which:

DETAILED DESCRIPTION

Figure 1:
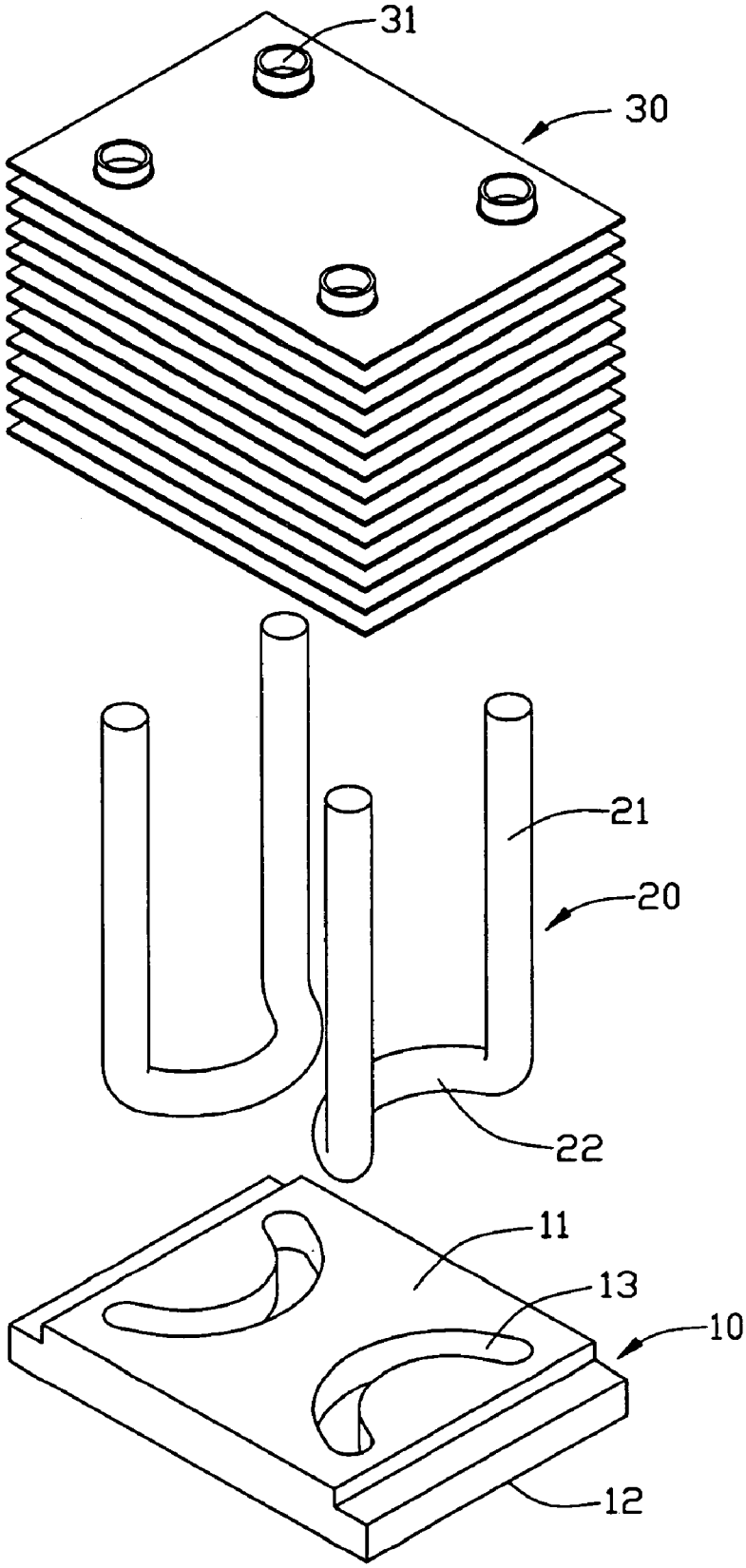
FIG. 1 is an exploded view of a heat dissipating device in accordance with one embodiment of the present invention.

Reference will now be made to the drawing figures to describe the present invention in detail.

Figure 2:
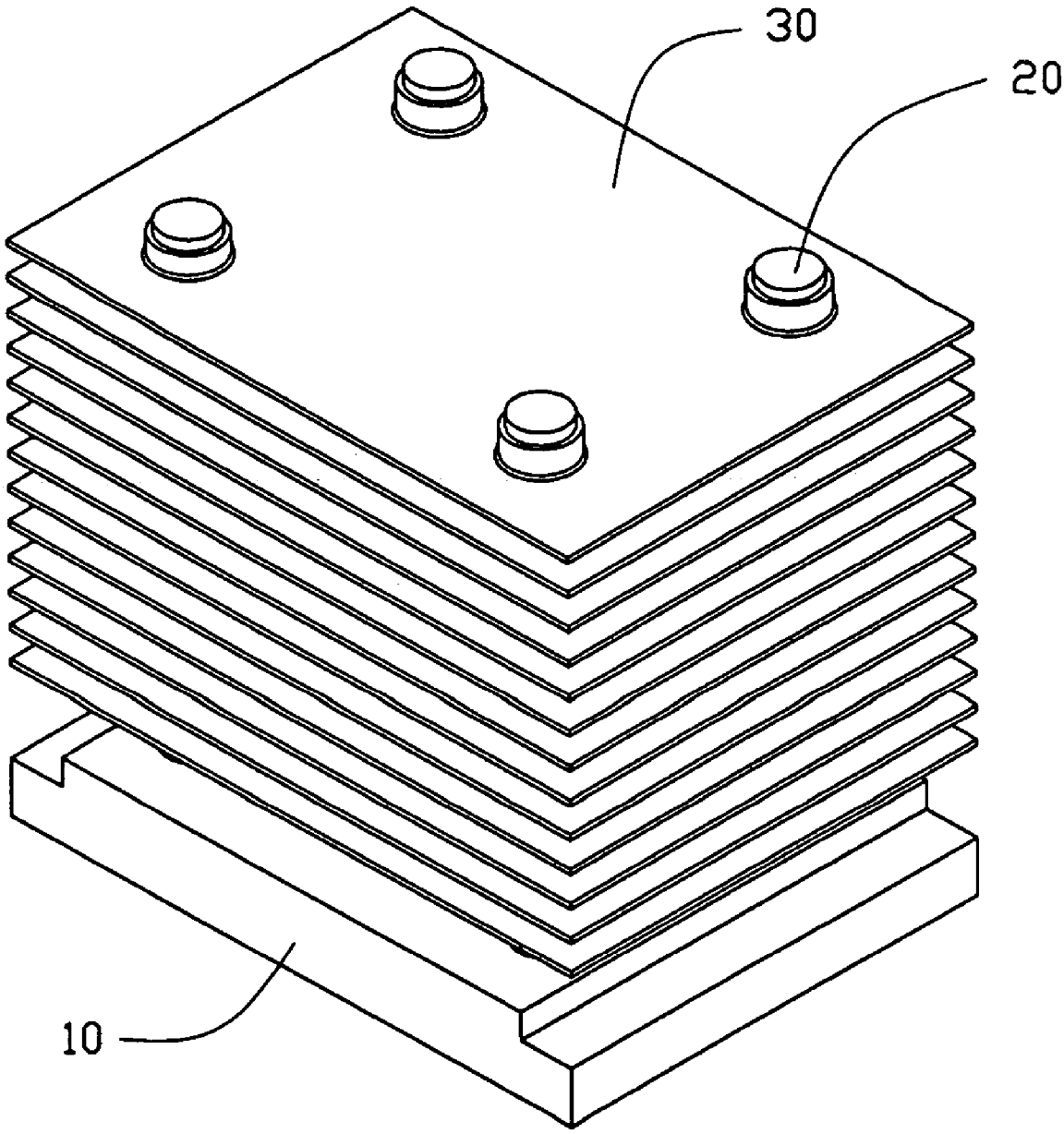
FIG. 2 is an assembled view of the heat dissipating device of FIG. 1.

FIG. 1 and FIG. 2 show a preferred embodiment of a heat dissipating device in accordance with present invention. The heat dissipating device comprises a heat receiver such as a base 10, a plurality of spaced heat-dissipating fins 30 and two heat pipes 20 thermally connecting the base 10 with the fins 30.

The base 10 has a top surface 11 and a bottom surface 12 opposite to the top surface 11. The bottom surface 12 of the base 10 is for contacting a heat-generating device (not shown). The base 10 defines a pair of symmetrical grooves 13 in the top surface 11 thereof. Each heat pipe 20 has two condensing portions 21 and an evaporating portion 22 disposed between the two condensing portions 21. The evaporating portion 22 of the heat pipe 20 is curved to form a continuous arc-shaped configuration, or alternatively bent to form a substantial U shape configuration or other configurations. The groove 13 of the base 10 has a mating shape with the evaporating portion 22. The two condensing portions 21 of each heat pipe 20 are parallel with each other, and preferably but not necessarily, extend perpendicularly from the evaporating portion 22. The fins 30 are arranged above the base 10, and each of the fins 30 are parallel to the top surface 11 of the base 10 and directly faces the top surface 11 thereof. Alternatively, the fins 30 may be disposed in a direction perpendicular to the base 10 or otherwise disposed. Each of the fins 30 symmetrically defines two pairs of holes 31 thereon, which is located adjacently to two opposite side edges of each of the fins 30.

In assembly, the heat pipes 20 are attached to the base 10 and the evaporating portions 21 are received in the grooves 13 of the base 10 for increasing contact surface between the heat pipes 20 and the base 10. The condensing portions 21 extend through the holes 31, and as a result, the fins 30 are attached to and stacked along the condensing portions 21. The fins 30 is in close proximity to the top surface 11 so that the evaporating portion 22 of the heat pipe 20 is substantially enclosed by the base 10 cooperating with the fins 30. The heat pipes 20 is attached to the base 10 and the fins 30 by means of soldering, bonding or being interferentially received in the grooves 13 or holes 31.

Referring to FIG. 1 and FIG. 2, when the base 10 is in thermally conductive relation to the heat-generating device, the heat pipes 20 absorbs heat from the base 10 via the evaporating portions 22 and transfers the heat to the fins 30 via the condensing portions 21, and further the fins 30 spread the heat to ambient air.

Figure 3:
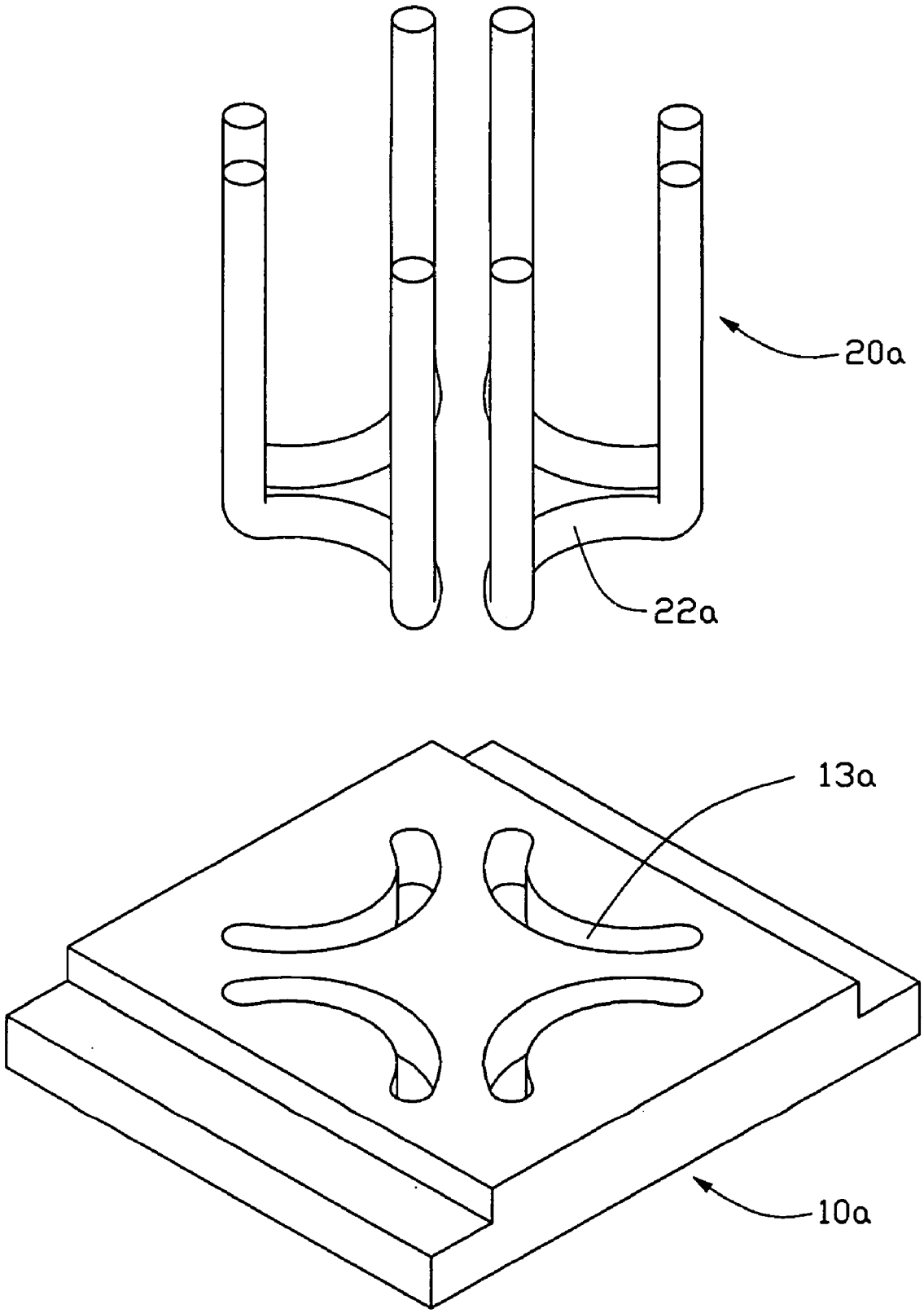
FIG. 3 is similar to FIG. 1, but showing four heat pipes and not showing the fins.

The number of heat pipes 20 incorporated in the heat dissipating device and the grooves 13 defined in the base 10 can be designed according to actual applications. As illustrated in FIG. 3, four heat pipes 20*a* are used. Each heat pipe 20*a* is almost the same as the heat pipe 20 of FIG. 1 and has an arc-shaped evaporating portion 22*a* which is attached to a corresponding groove 13*a* defined in a base 10*a*.

Figure 4:
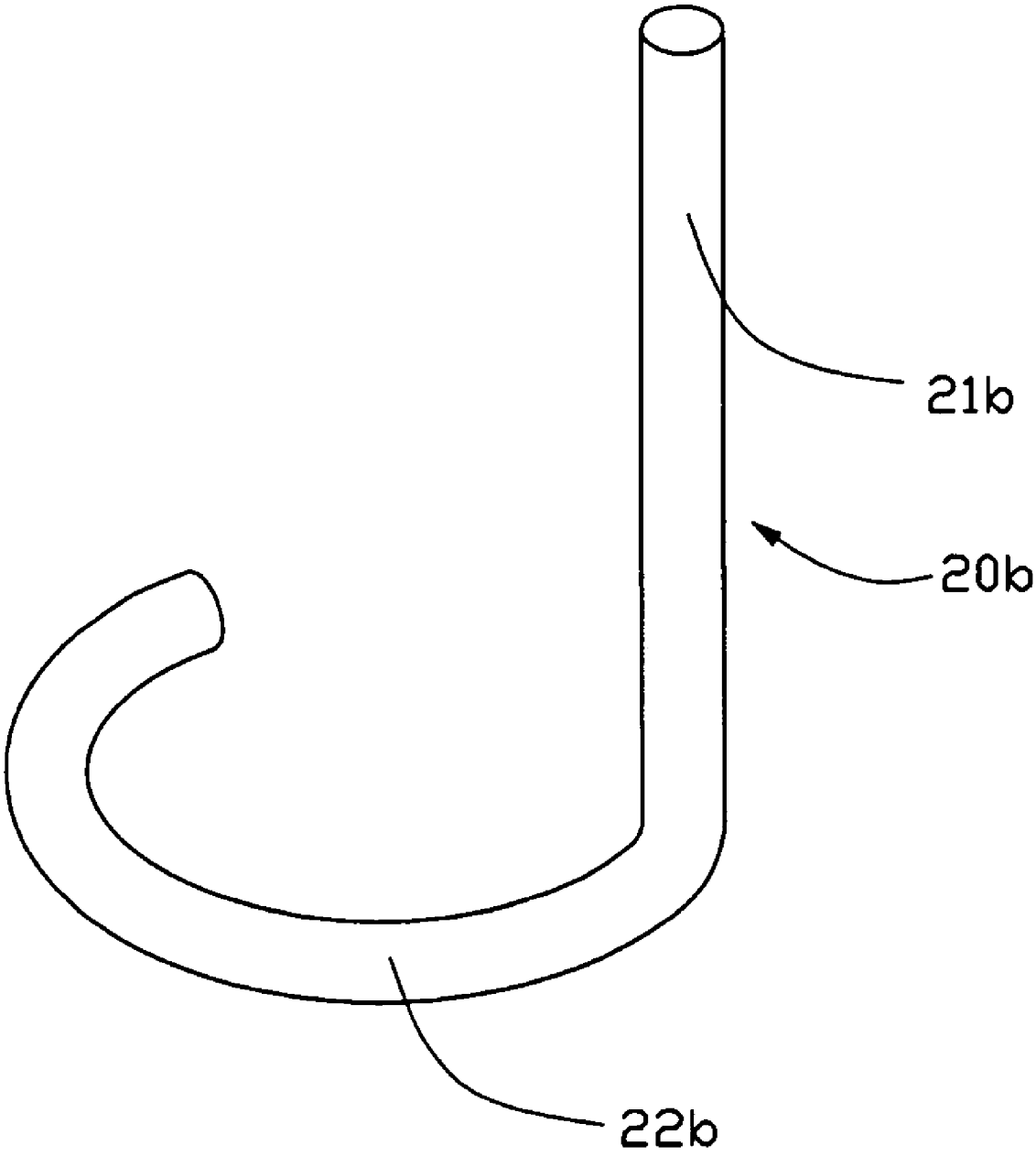
FIG. 4 is an isometric view of another kind of heat pipe of the heat dissipating device.

FIG. 4 shows another kind of heat pipe 20*b* suitable for the heat dissipating device of the present invention. The heat pipe 20*b* has an evaporating portion 22*b* at an end thereof and a condensing portion 21*b* at an opposite end thereof. The evaporating portion 22*b* of the heat pipe 20*b* is arc-shaped so as to increase the contact surface with a base.

The heat dissipating device of the present invention has achieved much better heat dissipation effect due to the evaporating portions of the heat pipes 20, 20*a*, 20*b* are curved in shape thereby increasing the contact surface between the heat pipes and the base to which the heat pipes are attached. Selectively, a fan unit can attach to the heat dissipating device for providing forced airflow to further enhance the heat dissipation efficiency of the heat dissipating device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. A heat dissipating device, comprising:

a base defining at least one groove at a surface thereof;

a plurality of heat-dissipating fins arranged above the base and directly facing the surface; and at least one heat pipe for transferring heat from the base to the fins, said at least one heat pipe comprising an evaporating portion attached in said at least one groove and a condensing portion extending through said fins, wherein the evaporating portion of said at least one heat pipe is curving in configuration and said at least one groove has a mating configuration with the evaporating portion for increasing contact surfaces between said at least one heat pipe and the base.

2. The heat dissipating device of claim 1, wherein the evaporating portion of said at least one heat pipe is arc-shaped.

3. The heat dissipating device of claim 1, wherein said at least one heat pipe further comprises another condensing portion and the evaporating portion is disposed between the condensing portion and the another condensing portion.

4. The heat dissipating device of claim 1, wherein said at least one heat pipe comprises the evaporating portion at an end thereof and the condensing portion at an opposite end thereof.

5. The heat dissipating device of claim 1, wherein the condensing portion of said at least one heat pipe extends away and substantially perpendicularly from the base.

6. The heat dissipating device of claim 1, wherein the heat-dissipating fins are arranged parallel to the surface of the base.

7. The heat dissipating device of claim 1, wherein the evaporating portion of said at least one heat pipe is approachable to said at least one curving groove of the base and attachable therein only along a direction from a location of the fins toward the base.

8. A heat dissipating device comprising:

a base defining at least one groove at a surface thereof;

at least one heat pipe comprising an evaporating portion received in said at east one groove and a condensing portion extending out of said at least one groove without passing through said base; and a plurality of heat-dissipating fins attached to said at least one heat pipe and stacked along the condensing portion, wherein the evaporating portion of said at least one heat pipe is substantially enclosed by the base cooperating with the fins and is curving in configuration for increasing contact surfaces between said at least one heat pipe and the base, wherein said at least one heat pipe further comprises another condensing portion and the evaporating portion is disposed between the condensing portion and the another condensing portion.

9. The heat dissipating device of claim 8, wherein the evaporating portion of said at least one heat pipe is arc-shaped.

10. The heat dissipating device of claim 8, wherein said at least one heat pipe comprises the evaporating portion at an end thereof and the condensing portion at an opposite end thereof.

11. A heat dissipating device comprising:

a heat receiver for receiving heat from a heat source;

at least one heat pipe comprising an evaporating portion contacting the heat receiver and a condensing portion extending away from the heat receiver; and a plurality of fins attached to said at least one heat pipe and stacked along the condensing portion, wherein said at least one heat pipe absorbs heat from the heat receiver via the evaporating portion and transfers the heat to the fins via the condensing portion, and the entire evaporating portion is continuously curving for increasing contact surfaces between the evaporating portion and the heat receiver, wherein the heat receiver comprises a first surface in which said at least one groove is defined and a second surface opposing to the first surface, and the fins and said at least one heat pipe both are located beside and away from the second surface of the heat receiver.

12. The heat dissipating device of claim 11, wherein the heat receiver defines at least one groove having a mating configuration with the evaporating portion of said at least one heat pipe, and the evaporating portion of said at least one heat pipe is received in said at least one groove.

13. The heat dissipating device of claim 11, wherein the evaporating portion of said at least one heat pipe is arc-shaped.

14. The heat dissipating device of claim 13, wherein said at least one heat pipe further comprises another condensing portion and, the evaporating portion is disposed between the condensing portion and the another condensing portion.

15. The heat dissipating device of claim 11, wherein said at least one heat pipe comprises the evaporating portion at an end thereof and the condensing portion at an opposite end thereof.

16. The heat dissipating device of claim 11 wherein the evaporating portion of said at least one heat pipe is not physically contactable to the heat source.

* * * * *